US005902422A

United States Patent [19]

Meyer et al.

[11] Patent Number: 5,902,422

[45] Date of Patent: May 11, 1999

[54] FERRITIC COILING OF WIRE OR BAR STEEL

[75] Inventors: Meinert Meyer, Erkrath; Hans-Georg Hartung, Pulheim; Wolfgang Roloff, Mönchengladbach; Paul-Josef Mauk, Düsseldorf, all of Germany

[73] Assignee: SMS Schloemann-Siemag Aktiengesellschaft, Düsseldorf, Germany

[21] Appl. No.: 08/992,985

[22] Filed: Dec. 18, 1997

[30] Foreign Application Priority Data

Dec. 19, 1996 [DE] Germany ..... 196 53 062

[51] Int. Cl.[6] ..... C21D 9/52

[52] U.S. Cl. ..... 148/595; 148/601

[58] Field of Search ..... 148/601, 602, 148/603, 595, 661

[56] References Cited

FOREIGN PATENT DOCUMENTS

| | | | |
|---|---|---|---|
| 698054 | 10/1967 | Belgium . | |
| 0058324 | 8/1982 | European Pat. Off. . | |
| 2414015 | 10/1974 | Germany . | |
| 354065118 | 5/1979 | Japan | 148/602 |
| 58-6936 | 1/1983 | Japan | 148/602 |
| 404276025 | 10/1992 | Japan | 148/602 |
| 406017125 | 1/1994 | Japan | 148/602 |
| 1549125 | 7/1979 | United Kingdom . | |

*Primary Examiner*—Deborah Yee
*Attorney, Agent, or Firm*—Friedrich Kueffner

[57] ABSTRACT

A method of coiling or placing bar steel or wire in coils, wherein the rolling stock is reeled from rolling heat in a basket or is placed by a coiler in the form of coils onto a conveyor and is collected at the end of the conveyor over a mandrel into a coil, wherein the rolling stock is cooled during coiling and the rolling stock is further cooled after the coiling process or the formation of coils. Cooling of the rolling stock from rolling heat prior to coiling into the transformation range characterized by the $Ar_3$ line or $Ar_1$ line of the transformation time-temperature diagram corresponding to the type of steel to be cooled is extended, such that, depending on the type of steel, the rolling stock is transformed immediately after cooling prior to, during or after coiling, uniformly over the entire length and entire cross-section thereof essentially isothermally from the austenite phase into the ferrite phase or pearlite phase and, as required, into the bainite phase.

7 Claims, 5 Drawing Sheets

FERRITIC COILING OF WIRE OR BAR STEEL

BACKGROUND OF THE INVENTION

1. Field of the Invention

The present invention relates to a method of coiling or placing bar steel or wire in coils, wherein the rolling stock is reeled from rolling heat in a basket or is placed by means of a coiler in the form of coils onto a conveyor means and is collected at the end of the conveyor means over a mandrel into a coil, wherein the rolling stock is cooled during coiling and the rolling stock is further cooled after the coiling process or the formation of coils.

2. Description of the Related Art

In conventional methods in which the wire or bar steel is reeled after rolling in a basket (for example, Garret reel) or is placed by means of a coiler in the form of coils on conveyor rollers or chains and at the end of this transport or conveyor device is collected over a mandrel into a coil, the coiling process or the placement of coils takes place at temperatures of between 800° and 1,000° C.

For example, EP-A-0 058 324 describes a device for the controlled cooling of rolled wire from rolling heat which is composed of a plurality of modules on a base frame, so that the device can be adapted to different cooling conditions. The first part in which cooling takes place has such a short length that the placement of the coils can take place already at about 850° C. This is carried out by means of a coiler which shapes the wire into coils having a helical shape and then places the coils on the subsequent conveyor in a second part of the cooling device. Additional cooling by means of air blowers takes place in this conveyor.

This known method has the disadvantage that it is only possible with complicated means to cool the rolling stock as quickly and uniformly as possible over the entire windings, in order to achieve a fine-grained, drawable material. However, since the windings at the edge of the conveyor means are placed much more closely together than in the center, this goal can only be achieved conditionally and with great technical expenditure, for example, with baffle plates, wobbling devices, etc.

A controlled and uniform cooling over the entire length of the rolling stock is even more difficult to achieve during reeling, for example, by means of the so-called Garret reel (rotary basked reel), as it is described in AT 393 806 B in which the wire or bar steel is directly coiled into a coil. Depending on the type of reel, the coiling density within the coil is more or less uniform and is subject to stochastic laws. This means that the cooling conditions for the individual windings within the coil cannot be controlled, so that the rolling stock

- has an inhomogeneous stress distribution over the length of the rolling stock;
- tends to form coarse grain which, however, is not uniform and, thus
- can only be subjected to an intensive cooling after it has been ensured that the entire coil has been converted structurally, since otherwise there would be the danger of the formation of a hardening structure. This would require long conveying distances and conveying times.

SUMMARY OF THE INVENTION

Therefore, it is the primary object of the present invention to provide a method of coiling or placing windings of bar steel or wire in which the above-described disadvantages due to non-uniform cooling are avoided or minimized.

In accordance with the present invention, in a method of coiling or placing bar steel or wire into coils, wherein bar steel or wire is reeled from rolling heat in a basket or is placed by means of a coiler in the form of windings on a conveyor means and at the end of the conveyor means is collected over a mandrel to form a coil, wherein the rolling stock is cooled during coiling and is further cooled after the coiling process or the formation of the coil, cooling of the bar steel or wire, i.e., the rolling stock, from rolling heat prior to coiling or placing the windings, is carried out into the transformation range which is characterized by the $Ar_3$ line or $Ar_1$ line of the transformation time-temperature diagram corresponding to the type of steel being cooled, whereby it is ensured that immediately after this cooling and, depending on the type of steel, prior to, during or after the coiling process or the formation of coils, the rolling stock is transformed over its entire length and its entire cross-section almost isothermally from the austenite phase into the ferrite phase or pearlite phase and, if necessary, into the bainite phase.

The measure according to the present invention of shifting a significant part of cooling before coiling or the placement of windings, wherein cooling is extended into the transformation range of the $Ar_3$ or $Ar_1$ line, so that coiling or the placement of windings takes place only at a temperature of about 650° C., makes it possible that the transformation into the ferrite phase or the pearlite phase and, if necessary, into the bainite phase takes place in a defined manner already before or during the coiling or placement of windings or immediately thereafter. In addition, further cooling which inevitably takes place during coiling or the placement of windings no longer influences the structure of the rolling stock, so that the position and the packing density of individual windings also no longer plays a role.

Since, in accordance with the method of the invention, the transformation takes place almost isothermally and uniformally over the entire length of the rolling stock, a uniform, fine-grained and stress-free structure with optimum strength properties is produced.

Coiling or placing windings at a low temperature of 650° C. has the additional advantage that the danger of damage to the surface is reduced by the reduced coiling or placement temperature. In accordance with the invention, the increase of the deformation resistance to be expected due to the lowering of the coiling or placement temperature from about 800°–1,000° C. to about 650° C. does not take place or only takes place to a limited extent when the transformation is already completely concluded. This is because the deformation resistance of the cubic body centered ferrite crystal is significantly lower than that of the cubic face centered austenite crystal.

When the transformation takes place only during or after the coiling or placement of windings, as is the case in accordance with the present invention, a greater coiling work in the order of magnitude of about 30% must be expected. However, this slight increase of the required energy is more than compensated by the savings in thermal aftertreatments and conveying devices.

In order to be able to have the transformation be carried out immediately after coiling or placement of windings, which may be found necessary depending on the type of steel, the present invention provides that the rolling stock is prevented from further cooling by means of cover plates or warming hoods, so that the transformation takes places almost isothermally.

In accordance with another advantageous further development of the invention, cooling which is extended into the transformation range is regulated and controlled in a controllable cooling stretch, preferably a water cooling stretch, in such a way that the surface of the rolling stock is not undercooled and reaches the range of the martensite formation (MS-line) in order to avoid undesirable hard spots on the surface of the rolling stock.

In accordance with another feature of the present invention, after the transformation into the desired ferrite phase/pearlite or bainite phase, and immediately after the coiling process or the formation of coils, the rolling stock is subjected to a first cooling to binding temperature and is subsequently conveyed to a binding station. This is possible because, due to the complete transformation into the desired phases which has already taken place, undesirable structural changes or inhomogeneous stress distribution do not have to be expected as a result of the forced cooling.

Consequently, it is no longer necessary to use transport or conveyor devices, such as coil conveyor belts, hook conveyors or similar devices which had the purpose of carrying out careful cooling.

The various features of novelty which characterize the invention are pointed out with particularity in the claims annexed to and forming a part of the disclosure. For a better understanding of the invention, its operating advantages, specific objects attained by its use, reference should be had to the drawing and descriptive matter in which there are illustrated and described preferred embodiments of the invention.

DESCRIPTION OF THE PREFERRED EMBODIMENTS

Example 1

Garret Reel a) Coiling using a Garret reel at 850° C. in accordance with the prior art, material Ck 45 (chemical composition in percent by weight: C=0.44; Si=0.22; Mn=0.66; P=0.022; S=0.029; Cr=0.15; V=0.02).

Examined was the cooling pattern to the transformation range of the $Ar_3$ line or the $Ar_1$ line in three different windings.

Figure 1:
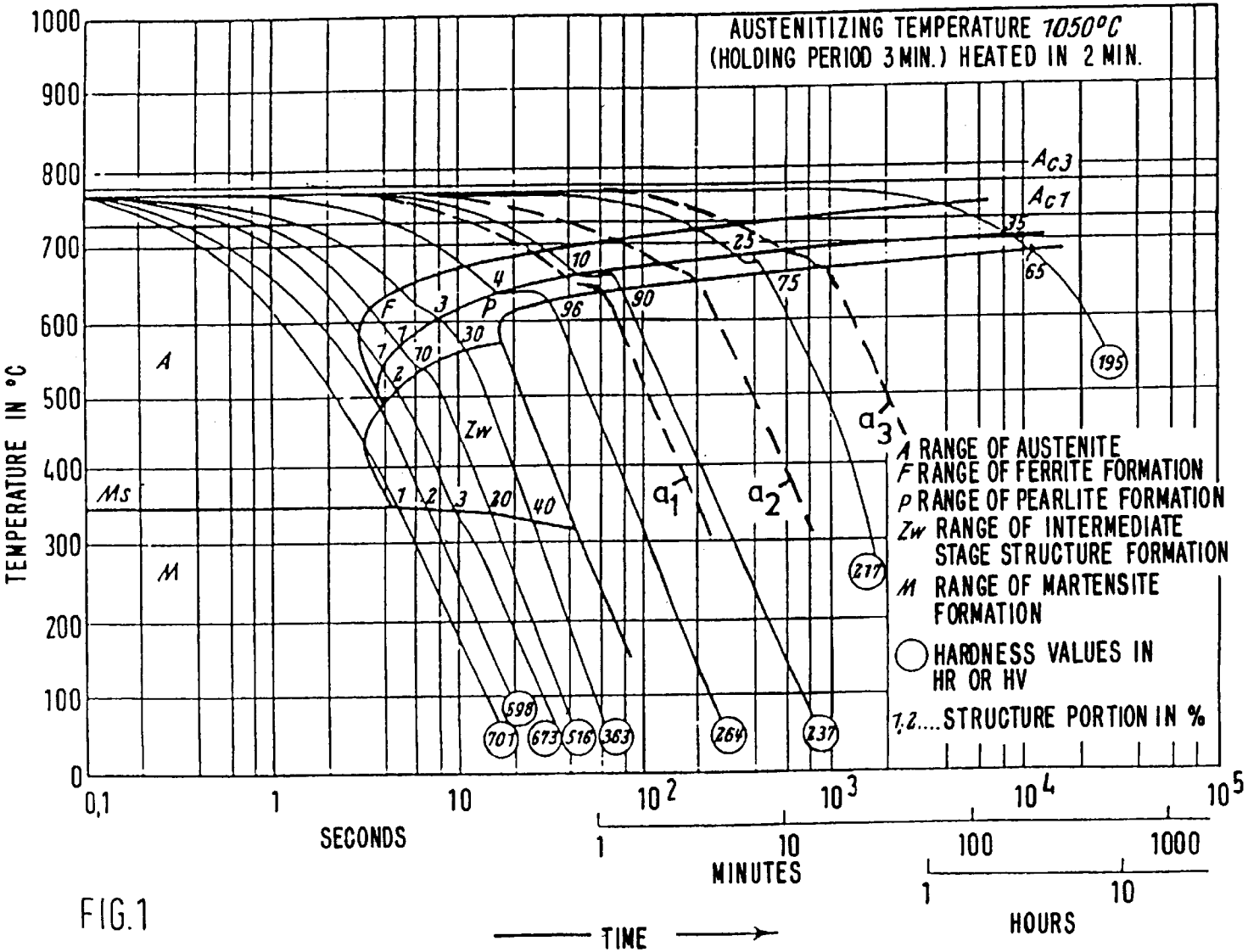
FIG. 1 is a transformation time-temperature diagram (continuous) for an embodiment according to the prior art.

FIG. 1 of the drawing shows a continuous transformation time-temperature diagram in accordance with the prior art for steel Ck 45. Determination method: dilatometric and metallographic in samples having a diameter of 4.5 mm and a length of 15 mm.; thermal analysis (gas quenching) in platelets having a diameter of 4 mm and a thickness of 0.5 of 1.0 mm. The cooling patterns of the three windings $a_1$, $a_2$, and $a_3$ which were examined are shown in broken lines. The windings are:

$a_1$—first winding (contact with cold coiler floor); at a cooling duration (from 850° C. to 630° C.) of 90 seconds, the achieved strength was 825N/m$^2$.

$a_2$—external winding at half coil height; $a_2$—first winding (contact with cold coiler floor); at a cooling duration (from 850° C. to 630° C.) of 200 seconds, the achieved strength was 765N/m$^2$.

$a_3$—internal winding at half coil height; $a_3$—first winding (contact with cold coiler floor); at a cooling duration (form 850° C. to 630° C.) of 20 minutes, the achieved strength was 695N/m$^2$.

It can be concluded that strength variations in this order of magnitude must be expected over the entire length of the rolling stock.

b) Coiling with the Garret reel at 650° C. after cooling in accordance with the method of the present invention (material Ck 45, as above). This cooling pattern is illustrated in FIG. 2 (line b).

Figure 2:
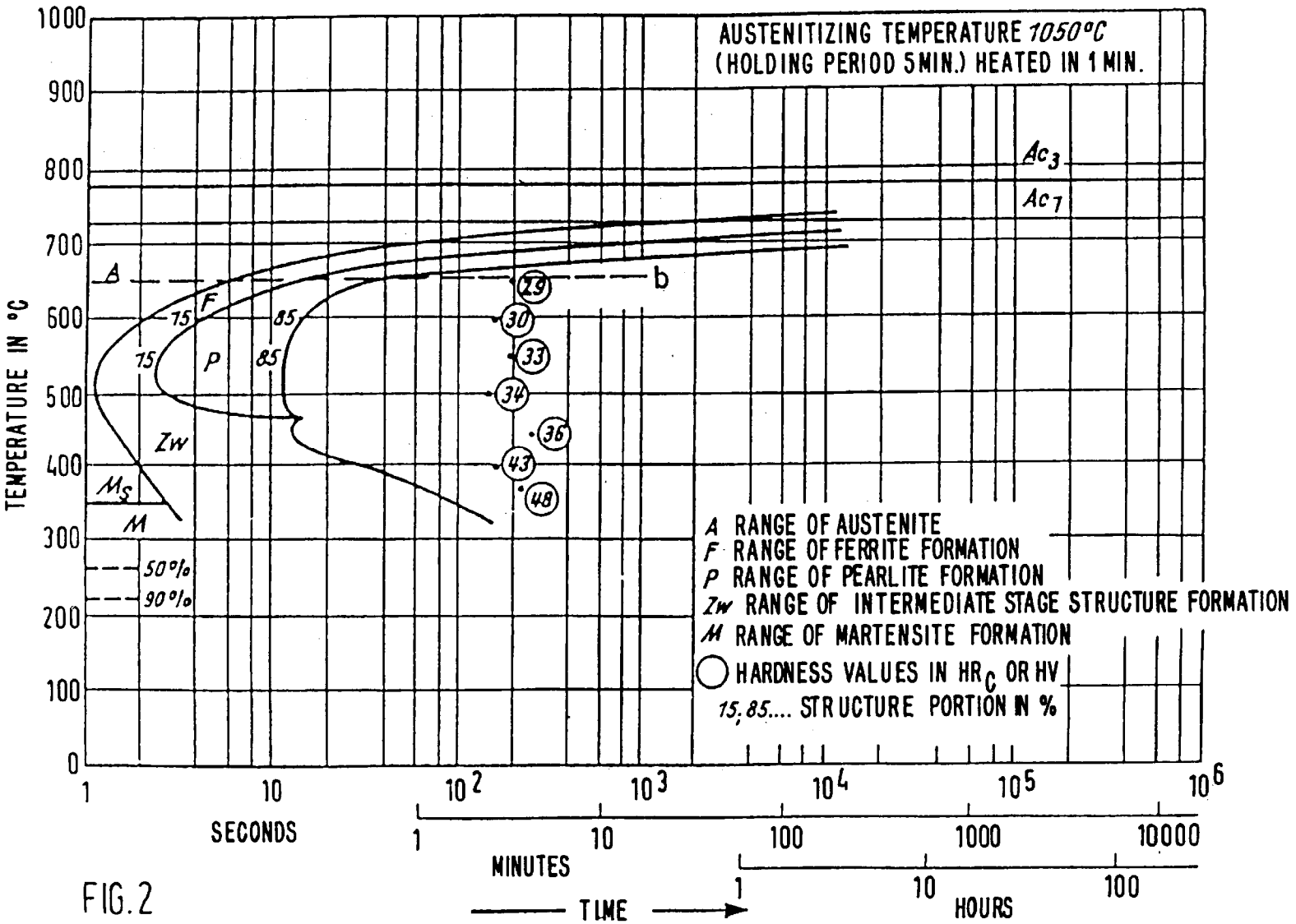
FIG. 2 is a transformation time-temperature diagram (isothermal) for an embodiment according to the present invention.

FIG. 2 is an isothermal transformation time-temperature diagram in accordance with the prior art. Determination method: dilatometric and metallographic in hollow samples having an outer diameter of 4 mm, an inner diameter of 3.2 mm and a length of 30 mm; metallographic in platelets having a thickness of 1.5 mm. As indicated by broken line b in FIG. 2, all windings which were examined transformed almost isothermally practically in accordance with the same conditions. The achieved strength was 930N/m$^2$ over the entire length of the rolling stock. Accordingly, the method of the invention makes it possible to achieve a uniform strength over the entire length of the rolling stock, wherein the strength is additionally in absolute terms also significantly higher than in those treated in accordance with the previously known methods.

Since it can be assumed that after coiling the rolling stock is transformed over the entire length of the rolling stock, it is possible to cool the coil immediately after being conveyed from the reel by forced air cooling or spray water cooling to the binding temperature, so that the conventional transport devices are for the most part no longer necessary.

Example 2

Coiler with Stelmor Belt a) Placing windings in accordance with the prior art using a placement temperature of 800° to 850° C.

At these placement temperatures, the transformation from the austenite phase into the ferrite phase or pearlite phase takes place after the placement on the conveyor belt. Because the wire windings are bundled at the side areas of the conveyor belt, different cooling rates occur within one winding which leads to variations in the strength. To ensure that the usually permissible strength variations of about 10 to 15 N/m$^2$ within one wire winding are not exceeded, significant technical expenditures are required (guided air flows, guide ducts, different belt speeds, etc.).

b) Placement of windings after cooling in accordance with the method of the present invention; placement temperature 650° C.

When the wire is cooled prior to the coiler to about 650° C. the transformation from the austenite phase into the ferrite or pearlite phase takes place already before or immediately after the placement on the conveyor belt, so that, in this case, it can also be assumed that variations especially within one winding are essentially eliminated and the total strength level is additionally raised.

Figure 5:
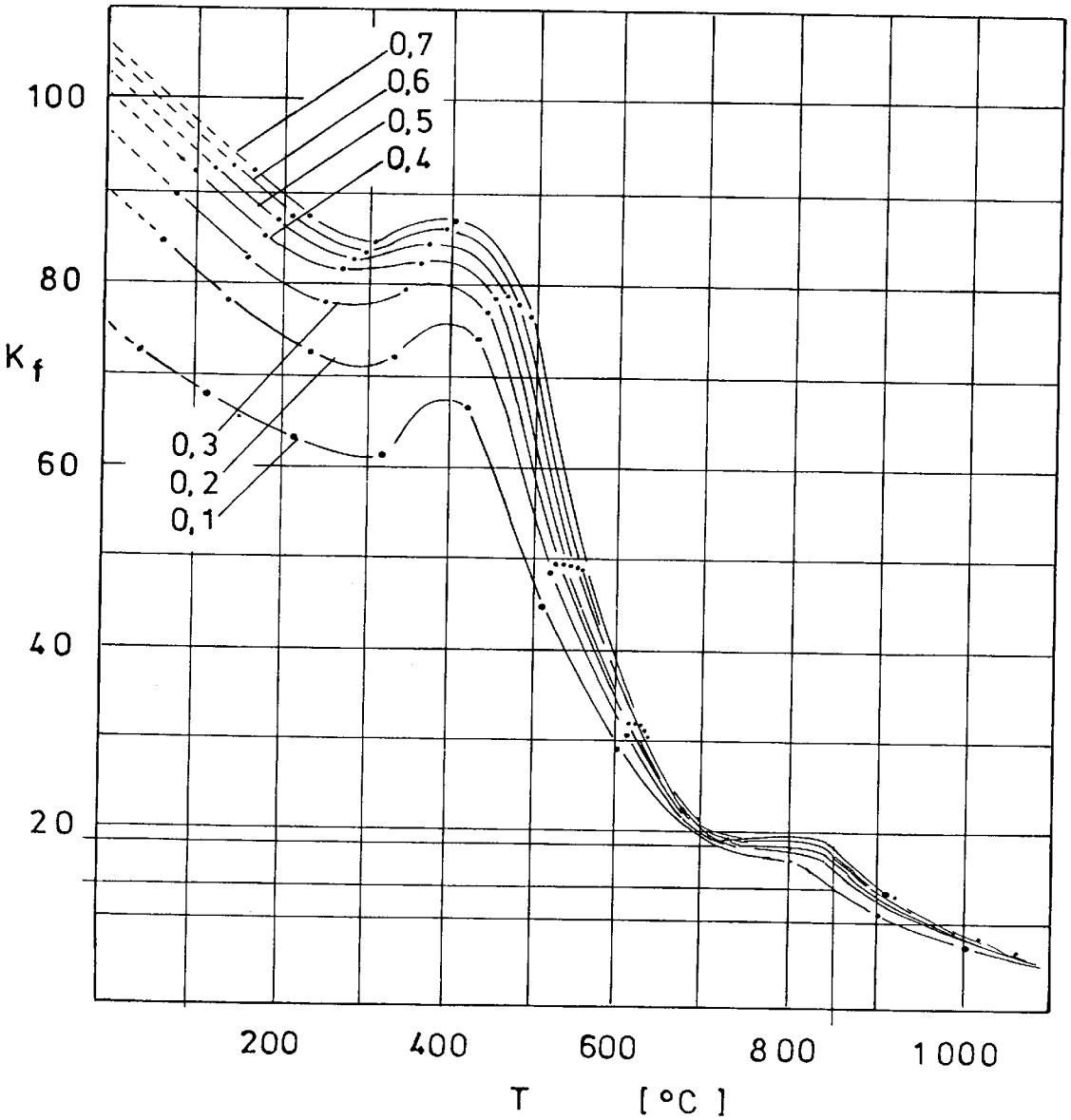
FIG. 5 is a $K_f$ temperature diagram for an alloyed tool steel (material: 100 Cr 6, average transformation rate $\phi_m$=0.1/s, family of curves $\phi$=0.1–0.7)
Figure 6:
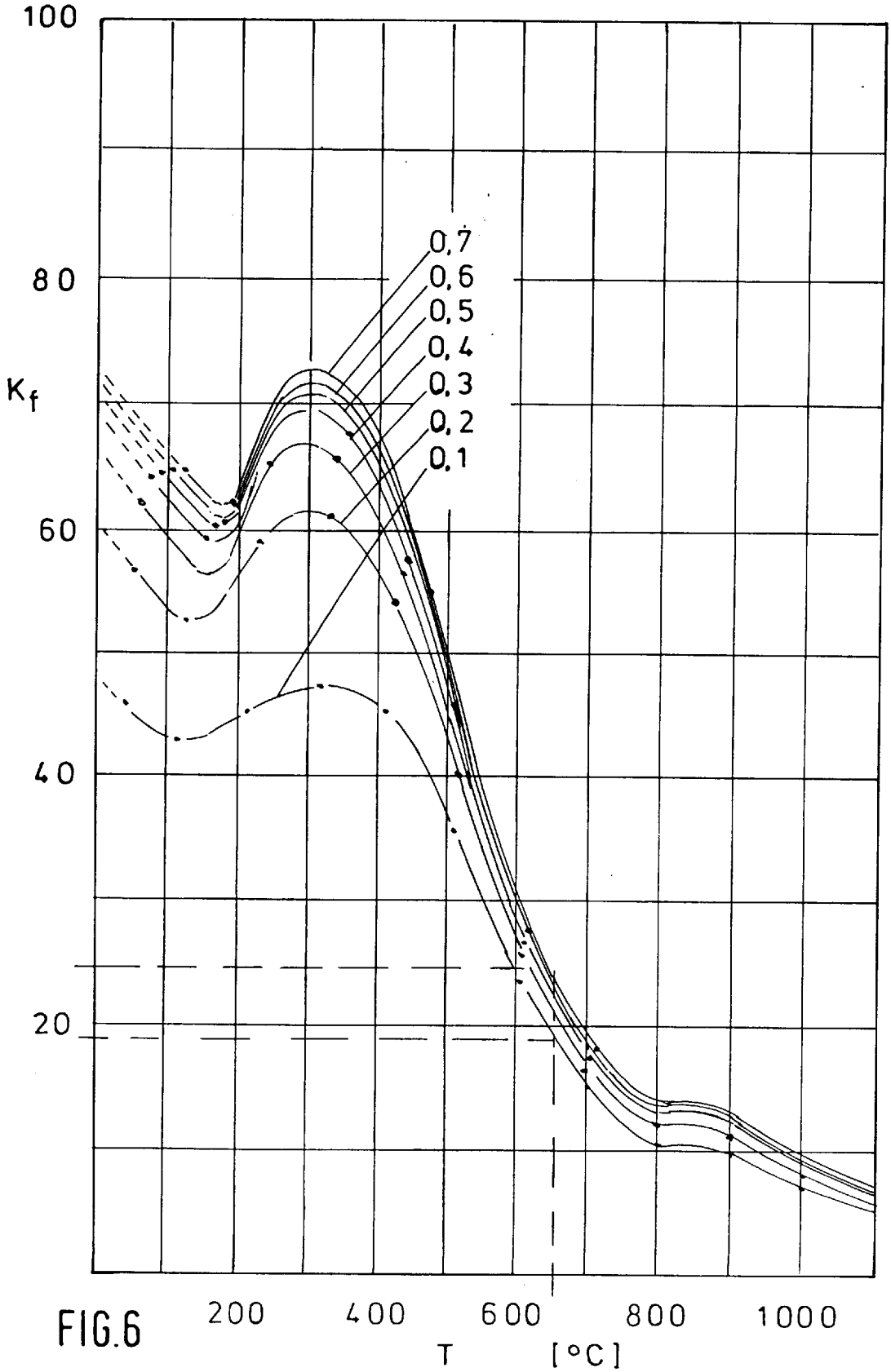
FIG. 6 is a $K_f$ temperature diagram for an unalloyed structural steel (material: C 15, average transformation rate $\phi_m$=0.1/s, family of curves $\phi$=0.1–0.7).

Cooling to 650° C., which causes the transformation into the ferrite phase or pearlite phase to take place prior to coiling or the placement of windings, makes it possible to utilize the fact that the steel in the austenite phase with a cubic face centered crystal lattice has a significantly higher $K_f$ value than the same steel after the transformation into the ferrite or pearlite phase having a cubic body centered crystal lattice. Consequently, when the temperature is lowered from 850° C. to 650° C., significantly higher coiling forces do not have to be expected, as is apparent from FIGS. 5 and 6 ($K_f$ temperature diagrams).

Figure 3:
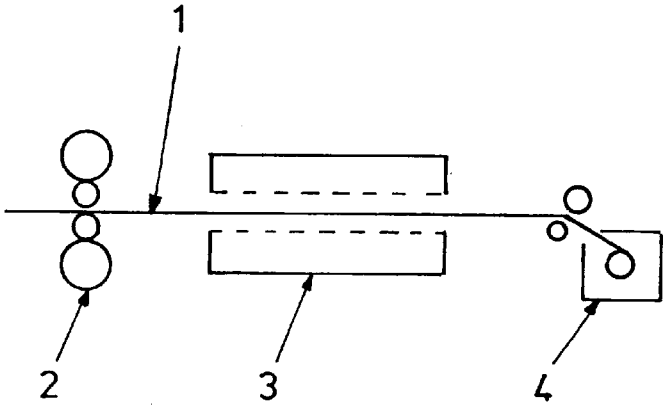
FIG. 3 is a schematic illustration of a portion of a rolling mill with a Garret reel.
Figure 4:
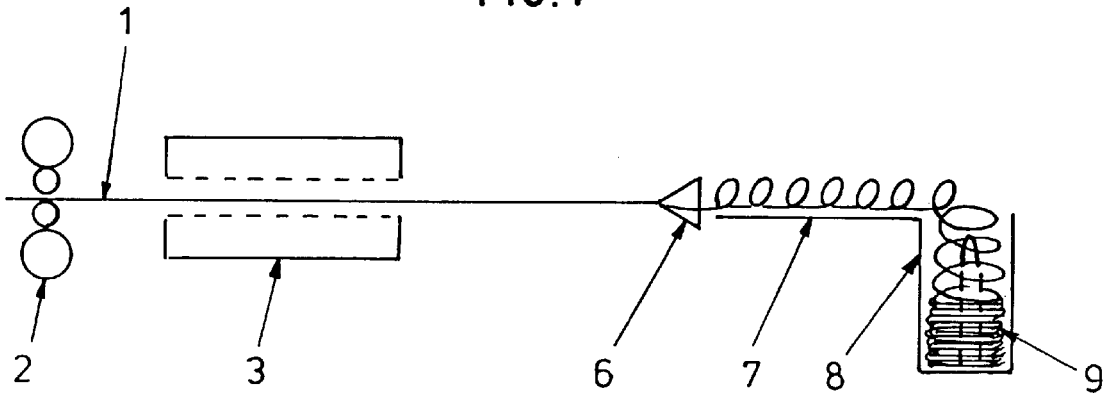
FIG. 4 is a schematic illustration of a portion of a rolling mill with a coiler.

FIGS. 3 and 4 of the drawing schematically illustrate cooling in accordance with the embodiments of the present invention mentioned above.

FIG. 3 shows a part of a rolling mill with a Garret reel. Emerging from the last roll stand 2, the rolling stock 1 reaches a cooling stretch 3 in which, in accordance with the present invention, the rolling stock 1 is cooled to the desired transformation range. During subsequent coiling in the Garret reel 4, the rolling stock is then already completely transformed, or the complete transformation takes place during coiling or immediately after coiling in the Garret reel 4, so that non-uniform structure configurations of individual windings do not have to be expected during coiling and, after the coiling process has been concluded, the produced coil is completely transformed and can be subjected to forced cooling outside of the Garret reel.

FIG. 4 of the drawing shows a part of a rolling mill with a coiler 6. In accordance with the invention, the rolling stock 1 is cooled in the cooling stretch 3 in front of the coiler 6 to the desired transformation range. When the windings are placed, the transformation is then either already completely concluded or the transformation takes place after the placement of the windings on the transport device 7, or only in the collecting device 8. Since the manner of cooling according to the present invention causes all windings to be transformed almost isothermally, the produced coil 9 can also in this case be subjected to forced cooling to binding temperature immediately after emerging from the collecting device 8.

The method according to the present invention is not limited to the embodiments described above; rather, the method of the present invention can be used generally in all devices for coiling or placing windings, wherein it is additionally possible to use different cooling devices prior to coiling or placing the windings than the ones described above.

While specific embodiments of the invention have been shown and described in detail to illustrate the inventive principles, it will be understood that the invention may be embodied otherwise without departing from such principles.

We claim:

1. In a method of coiling rolling stock in the form of bar steel or wire or placing the rolling stock in windings, wherein the rolling stock is reeled from rolling heat in a basket or is placed by a coiler in the form of windings on a conveyor means and is collected at an end of the conveyor means over a mandrel into a coil, wherein the rolling stock is cooled during reeling or placing into windings and is further cooled after reeling or placing into windings, the improvement comprising carrying out cooling of the rolling stock from rolling heat to about 650° C. prior to reeling the rolling stock or placing the rolling stock into windings, such that, depending on the type of steel, the rolling stock is transformed immediately after cooling prior to, during or after reeling or placing into coils, uniformly over the entire length and entire cross-section thereof essentially isothermally from the austenite phase into the ferrite phase or pearlite phase and, as required, into the bainite phase.

2. The method according to claim 1, comprising, in types of steel which transform only after coiling, preventing further cooling by using cover plates or holding hoods, so that the transformation takes places essentially isothermally.

3. The method according to claim 1, comprising carrying out cooling of the rolling stock such that the surface of the rolling stock is not undercooled and reaches the range of martensite formation.

4. The method according to claim 1, comprising carrying out cooling of the rolling stock such that the transformation into the ferrite phase or pearlite phase is completely concluded prior to the coiling process, whereby the low deformation resistance of the ferrite phase or pearlite phase due to the cubic body centered crystal lattice of these phases can be utilized during coiling.

5. The method according to claim 1, comprising cooling the rolling stock to the desired transformation range in a controllable cooling stretch.

6. The method according to claim 5, comprising cooling the rolling stock in a water cooling stretch.

7. The method according to claim 1, comprising, after transformation has been completed and coiling has been carried out, subjecting the rolling stock to forced cooling to binding temperature.

* * * * *